US007204767B2

(12) United States Patent
Roberts et al.

(10) Patent No.: US 7,204,767 B2
(45) Date of Patent: Apr. 17, 2007

(54) SWING PROGRAMMER APPARATUS

(76) Inventors: Rick E. Roberts, 7636 W. 149th St., Overland Park, KS (US) 66223; Linda Roberts, 7636 W. 149th St., Overland Park, KS (US) 66223

( * ) Notice: Subject to any disclaimer, the term of this patent is extended or adjusted under 35 U.S.C. 154(b) by 0 days.

(21) Appl. No.: 10/876,961

(22) Filed: Jun. 25, 2004

(65) Prior Publication Data

US 2005/0288121 A1 Dec. 29, 2005

(51) Int. Cl.
*A63B 69/36* (2006.01)

(52) U.S. Cl. ..... 473/276; 473/212

(58) Field of Classification Search ..... 473/207, 473/208, 212–217, 266, 275, 276
See application file for complete search history.

(56) References Cited

U.S. PATENT DOCUMENTS 1,699,219 A * 1/1929 Bemish et al. ..... 473/212
2,774,601 A * 12/1956 White ..... 473/208
4,058,852 A * 11/1977 Aragona ..... 2/115
4,890,841 A * 1/1990 Brooks ..... 473/212
5,205,735 A * 4/1993 McLauchlan ..... 433/5
5,738,640 A * 4/1998 Carlson-Orsi ..... 602/19
5,795,238 A * 8/1998 Nicholson ..... 473/214
6,052,848 A * 4/2000 Kelly ..... 5/632
6,219,865 B1 * 4/2001 Stokesbary ..... 5/637
6,231,535 B1 * 5/2001 Mainiero et al. ..... 602/18

* cited by examiner

*Primary Examiner*—Nini F. Legesse
(74) *Attorney, Agent, or Firm*—Chase Law Firm, L.C.

(57) ABSTRACT

A golf swing improvement apparatus which is worn by a golfer and helps the golfer develop a repetitive and consistent golf swing that improves golf scores. The golf swing apparatus includes a generally U-shaped body with tabs extending from the arms and a strap to secure the apparatus to the golfer's arm. The apparatus helps the golfer feel the proper contact of his or her arm during the swing and the tabs help limit the golfer's swing.

15 Claims, 2 Drawing Sheets

SWING PROGRAMMER APPARATUS

FIELD OF THE INVENTION

The present invention relates to an apparatus to improve a golf swing and, more particularly, to an apparatus which is worn by a user and helps the user develop a repetitive and consistent golf swing that improves golf scores.

BACKGROUND OF THE INVENTION

Golf is played by millions of people worldwide. Enjoyment of the game is often tied to the player's performance and consequently, score. One difficulty that an amateur golfer encounters is consistency in the player's swing due to a lack of feedback and not having learned the proper swing. A golfer may periodically take lessons to improve his or her golf game. However, without playing regularly or consistently and with a learned feel for the proper technique, the improvements made from instruction are often lost.

Another method used by many golfers to improve their game is the use of training aids and devices. These devices include practice swing devices, devices that attach to the player's clubs, devices that are placed on the ground in the target zone and video systems which may be analyzed at a later time. Some problems with these training aids and devices are the golfer is not using or training with his or her clubs, or the golfer is not focused on the ball or swing but the training device, or the golfer does not get immediate feedback. The golfer does not get a feel for the proper swing using his or her own clubs and any improvement made using the training aid is lost when the golfer's own clubs are used. Additionally, often the aids cannot be used during a round of golf or, in some cases, the golfer would not want to use the aid during a round of golf.

One common problem a golfer encounters is the loss of control of the golf club in the backswing, which results in an inconsistent golf swing and consequently reduced accuracy of golf shots and higher scores. This loss of control is often caused by the golfer "disconnecting" the lead swing arm from their body in the back swing. A key point for consistent swings for all golf shots centers around the contact point between the body and the arms. This point is the arm pit of the lead arm.

SUMMARY OF THE INVENTION

The apparatus of the present invention helps teach a golfer to maintain a contact point between the body and arms and develop a compact back swing to improve swing consistency. The swing programmer includes a body with an attached strap which is secured to the golfer's arm under the golfer's arm pit. A raised tab or cylinder member extends from each arm of the body. The swing programmer allows the golfer to feel when his or her arm is in contact with the body and alternatively when the golfer's arm is not in contact with his/her body. The tabs prevent the golfer from taking too long a back swing resulting in a compact and thus more consistent swing. After the golfer uses the apparatus and recognizes and learns the "feel" of the proper positioning of his/her arms, the golfer retains the feel when the apparatus is not used.

DETAILED DESCRIPTION

Figure 1:
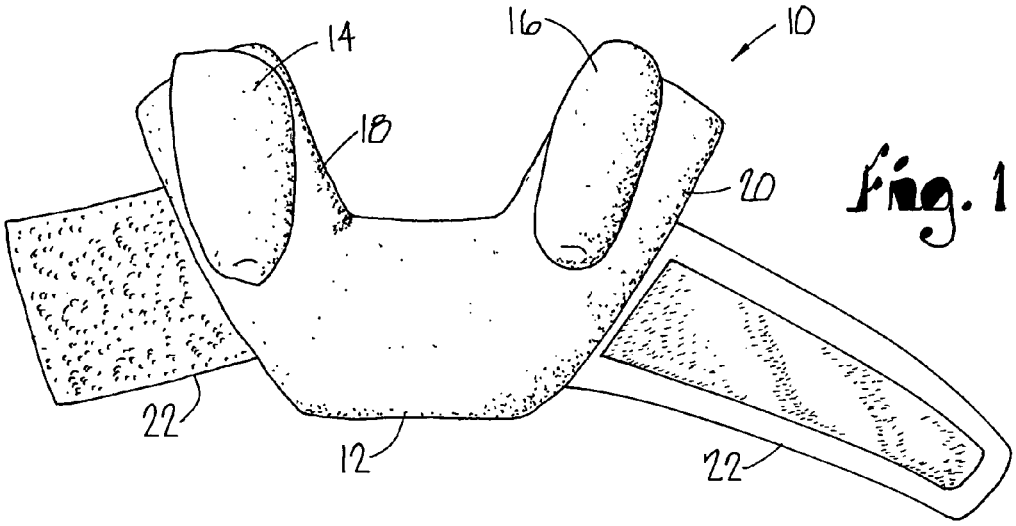
FIG. 1 is a front elevational view of the golf swing programmer of the present invention.
Figure 2:
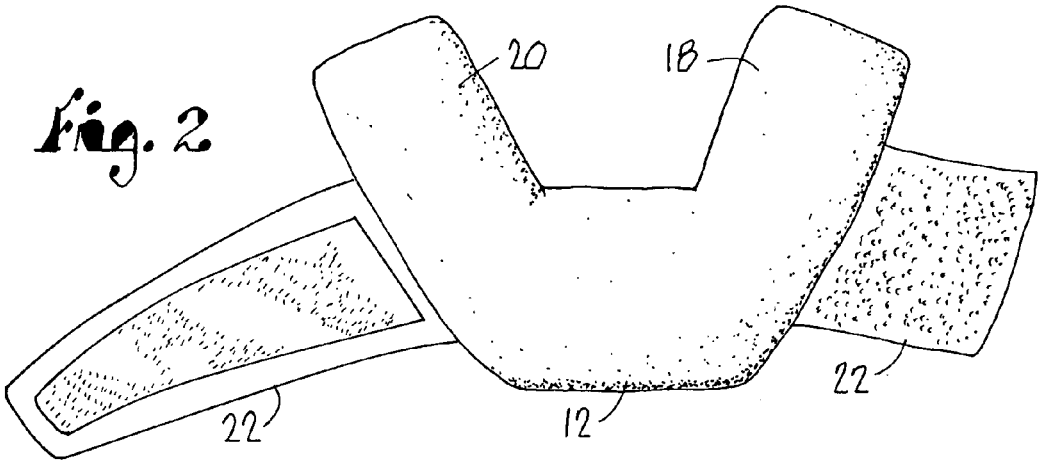
FIG. 2 is a rear elevational view of the golf swing programmer of FIG. 1.
Figure 3:
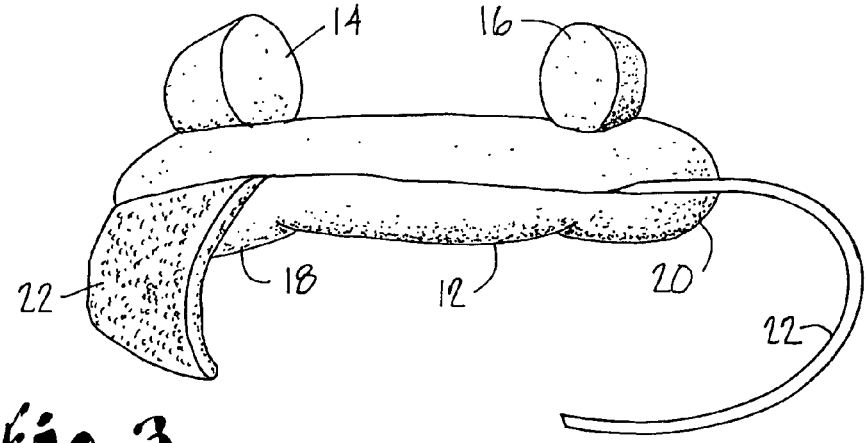
FIG. 3 is a bottom view of the golf swing programmer of FIG. 1.
Figure 4:
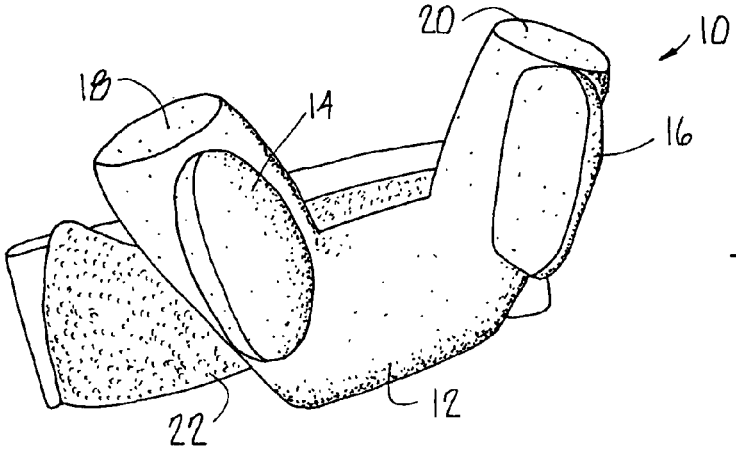
FIG. 4 is a perspective view of the golf swing programmer of FIG. 1.

Referring to FIGS. 1–4, the golf swing programmer of the present invention is generally indicated by reference numeral 10. Golf swing programmer 10 includes a body 12, raised tabs 14 and 16 secured to arms 18 and 20 extending from the body 12 and a strap or belt 22 secured to the body 12. Strap 22 may include Velcro® to adjustably secure the strap around a golfer's arm. The body 12 and arms 18 and 20 are arranged in a generally "U" shape.

The body 12 is shaped to comfortably fit under a golfer's arm. The arms 18 and 20 may be angled outwardly to generally follow the contours of a golfer's body in front of the golfer's shoulder, under the arm and to the back of the golfer's shoulder. The body 12 may include a fabric cover which is sewn together and filled with a soft, firm stuffing material such as foam rubber. The fabric may include a rubberized, non-slip coating or other material to help keep the golf swing programmer 10 in place. The body 12 may be approximately one-half to one-inch thick and compressible so that it may be comfortably used while swinging a golf club. The body 12 and tabs 14 and 16 may be injection molded and not include a fabric cover. Strap 22 may be embedded in the body 12 during the molding process to securely affix the strap 22 to the body 12.

Tabs 14 and 16 extend outwardly from arms 18 and 20, respectively, of body 12. Tabs 14 and 16 are positioned to fit on each side of a golfer's arm. The tabs 14 and 16 may be made of a fabric sewn together and filled with a stuffing material such as foam rubber and sewn or otherwise attached to arms 18 and 20 of the body 12.

Although the tabs 14 and 16 are shown as separate pieces attached to the body 12, all of these pieces may be constructed of one piece of foam rubber or other suitable material using an injection molding process, for example.

Straps 22 are attached to each arm 18 and 20 of body 12 and extend outwardly. The straps 22 include Velcro® or other adjustable fastening material. Straps 22 are long enough to fit around a variety of different sized arms of golfers and are approximately two inches wide. Strap 22 may be embedded in the body 12 during the molding process to securely affix the strap 22 to the body 12.

Figure 5:
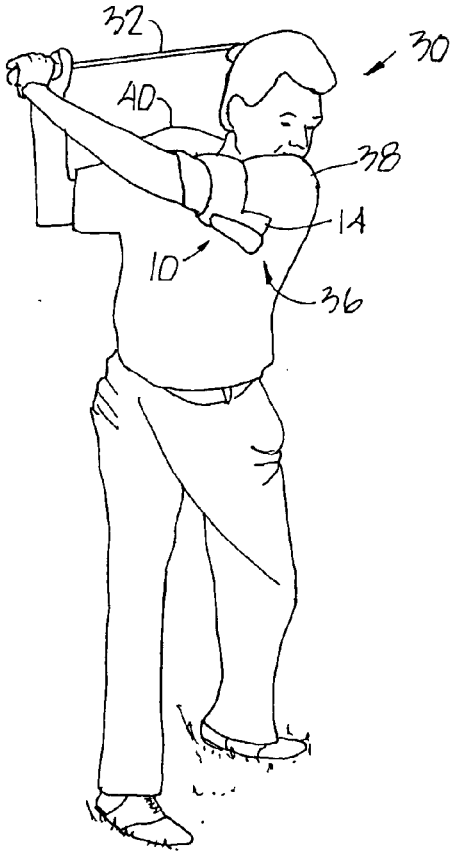
FIG. 5 is a view of the golf swing programmer attached to the arm of a golfer in a back swing.
Figure 6:
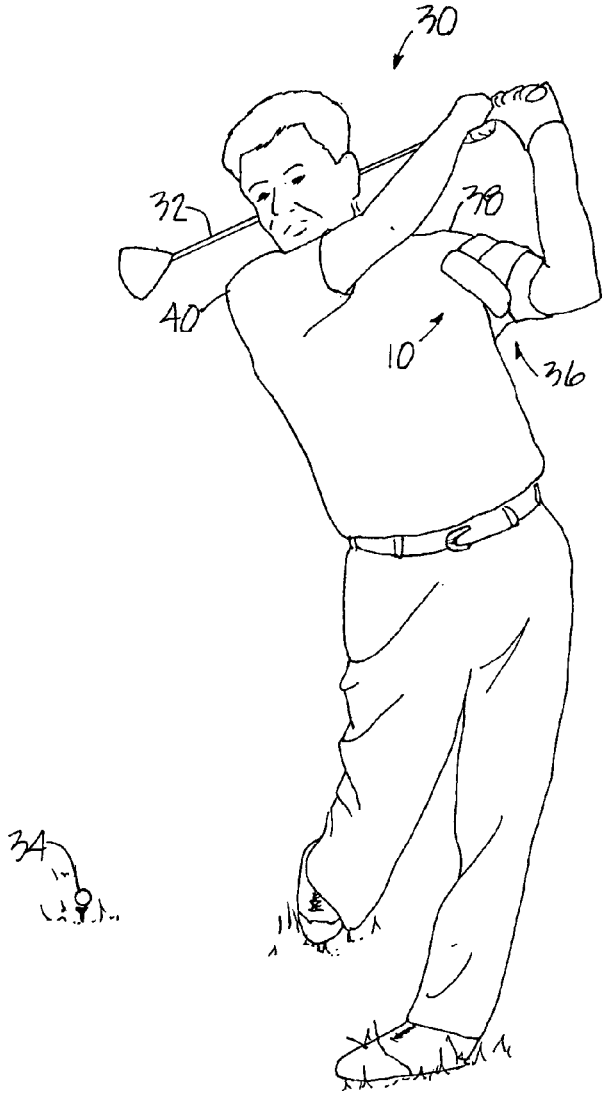
FIG. 6 is a view of the golf swing programmer of FIG. 5 after the follow-through swing.

Referring to FIGS. 5 and 6, a golfer 30 is illustrated swinging a golf club 32. The golfer 30 begins by addressing the golf ball 34. During the back swing (FIG. 5), as the golf club 32 is swung back, the golfer 30 can feel when the golf swing programmer 10 loses contact with the portion of his body under his arm 36. Additionally, the tab 14 and arm 18 obstruct the back swing at a point to limit the back swing and help develop or program a compact back swing. Throughout the back swing, the golfer 30 should feel the pressure in the area 36 under his/her arm from the golf swing programmer 10 if he/she keeps his/her arm in the proper position. As the golfer 30 swings through the ball 34, the golf swing programmer 10 does not obstruct the golfer's swing.

As illustrated in FIGS. 5 and 6, the golf swing programmer 10 is adjustably secured to the golfer's 30 left arm under the lead shoulder 38 with the tabs 14 and 16 projecting outwardly from the body 12. The golf swing programmer 10 may also be worn with the tabs 14 and 16 facing inwardly from the body 12 toward the golfer's body. The golf swing programmer 10 may be worn on either arm to be used by either a right or left handed golfer.

The golf swing programmer 10 may also be used under the trailing shoulder 40. With contact maintained on the lead side shoulder and the left arm kept straight, the golf swing programmer 10 helps the golfer 30 develop a feeling for keeping his right elbow in to generate an inside-out swing path.

It should be appreciated that the golf swing programmer 10 may be sized for junior golfers to large golfers. The golf swing programmer may be worn at the driving range as well as at the golf course and is used with the golfer's own clubs. The golf swing programmer 10 works for all shots, including drives using woods and irons, chipping, pitching, putting and bunker shots, for example. The golf swing programmer 10 promotes a shorter, controlled and thus repetitive back swing to improve the golfer's swing and thus improve the golfer's game.

Having thus described the invention, what is claimed as new and desired to be secured by Letters Patent is:

1. A golf club swing improvement apparatus shaped to fit under a golfer's arm, said apparatus comprising:

a body having a generally circular cross-section, a pair of arms extending from said body, a pair of raised tabs each extending outwardly from and generally parallel to said arms, said tabs having a generally cylindrical shape, and a strap secured to said body for securing the apparatus to an arm of a golfer, wherein said tabs fit on each side of the golfer's arm when extending toward the golfer's arm to help maintain the apparatus in position with respect to the golfer's arm when the golfer is swinging a golf club, and wherein said tabs fit on each side of the golfer's body when extending toward the golfer's body to help maintain the apparatus in position with respect to the golfer's body when the golfer is swinging a golf club.

2. The apparatus as set forth in claim 1 wherein said arms extend generally upwardly from said body to form a generally U shape.

3. The apparatus as set forth in claim 2 wherein said arms extend generally outwardly from each other.

4. The apparatus as set forth in claim 1 wherein said arms have a generally circular cross-section.

5. The apparatus as set forth in claim 1 wherein said tabs have a generally circular cross-section.

6. The apparatus as set forth in claim 1 further comprising a fabric covering encasing said body, arms and tabs.

7. The apparatus as set forth in claim 6 wherein said fabric covering includes a surface treatment to reduce slipping of said apparatus in use.

8. The apparatus as set forth in claim 1 wherein said strap is adjustable.

9. A golf club swing improvement apparatus comprising:

a generally U-shaped body having a pair of arms extending generally upwardly and outwardly from said body, a pair of generally cylindrical tabs extending from and generally parallel to said arms, and a strap secured to said body for securing the apparatus to an arm of a golfer, wherein said tabs fit on each side of the golfer's arm when extending toward the golfer's arm to help maintain the apparatus in position with respect to the golfer's arm when the golfer is swinging a golf club, and wherein said tabs fit on each side of the golfer's body when extending toward the golfer's body to help maintain the apparatus in position with respect to the golfer's body when the golfer is swinging a golf club.

10. The apparatus as set forth in claim 9 wherein said body has a generally circular cross-section.

11. The apparatus as set forth in claim 9 wherein said arms have a generally circular cross-section.

12. The apparatus as set forth in claim 9 wherein said tabs have a generally circular cross-section.

13. The apparatus as set forth in claim 9 further comprising a fabric covering encasing said body, arms and tabs.

14. The apparatus as set forth in claim 13 wherein said fabric covering includes a surface treatment to reduce slipping of said apparatus in use.

15. The apparatus as set forth in claim 9 wherein said strap is adjustable.

* * * * *